US005908033A

United States Patent [19]

Korte, Sr. et al.

[11] Patent Number: 5,908,033

[45] Date of Patent: Jun. 1, 1999

[54] TOBACCO DRYING APPARATUS

[75] Inventors: Kevin R. Korte, Sr., Macon; Stacey Claire Braxton, Griffin; Kayyani Adiga, Macon, all of Ga.

[73] Assignee: Brown & Williamson Tobacco Corporation, Louisville, Ky.

[21] Appl. No.: 08/933,686

[22] Filed: Sep. 19, 1997

Related U.S. Application Data

[63] Continuation of application No. 08/726,010, Oct. 4, 1996, Pat. No. 5,720,306

[60] Provisional application No. 60/017,130, May 17, 1996.

[51] Int. Cl.[6] ..... A24B 3/18

[52] U.S. Cl. ..... 131/296; 131/291; 131/302

[58] Field of Search ..... 131/296, 291, 131/302

[56] References Cited

U.S. PATENT DOCUMENTS 5,720,306 2/1998 Korte, Sr. et al. ..... 131/296

*Primary Examiner*—John G. Weiss

*Assistant Examiner*—Charles W. Anderson

*Attorney, Agent, or Firm*—Middleton & Reutlinge; John F. Salazar; Charles I. Sherman

[57] ABSTRACT

A high humidity drying apparatus for cut tobacco is shown. The apparatus has a furnace which heats circulated air within the apparatus. The air is forced through a first arcuate elbow which has a tobacco air inlet located thereon for inserting the cut tobacco into the airstream. The tobacco is then redirected into a vertically extending drying chamber. The air entrained tobacco is then forced through a second arcuate elbow which places the tobacco into a tangential separator for removing the tobacco from the heated air. The separator has dual air exhausts, each leading to a high efficiency cyclone for further removal of the tobacco dust form the circulated air. All of the air is then passed back to the furnace for heating and then recirculated through the drying apparatus.

18 Claims, 6 Drawing Sheets

TOBACCO DRYING APPARATUS

This is a continuation of prior application Ser. No. 08/726,010 filed on Oct. 4, 1996 now U.S. Pat. No. 5,720, 306, and a provision of Ser. No. 60/017,130 filed May 17, 1996.

BACKGROUND OF THE INVENTION

1. Field of the Invention

The present invention relates to an apparatus for drying cut tobacco and more particularly to an apparatus for drying tobacco under relatively high humidity drying conditions.

2. Discussion of the Prior Art

In the manufacture of cigarettes and like articles, it is the usual practice to reduce tobacco, the term being used herein to include both lamina and stems, to a particle size appropriate for manufacturing cigarettes. The moisture content of the tobacco is generally increased prior to this size reduction processing in order to minimize tobacco breakup and provide a material of uniform particle size. Furthermore, in order to process the treated tobacco in the manufacturing of cigarette rods, it is necessary to reduce the moisture content of the tobacco to a level below that which the tobacco is at after treatment by casings, flavorings and other additives. The actual drying process has a direct impact upon the quality of tobacco utilized during cigarette manufacturing because of the effect the drying process has upon the tobacco material itself.

Additionally, drying of tobacco after the addition of flavorings and casings has a direct impact upon the quality of the tobacco itself. If, during drying, the tobacco is subjected to rigorous agitation or contact with stationary surfaces, the tobacco material can be damaged by breakup thus decreasing the filling capacity of the tobacco. This unwanted result is also achieved when drying under low humidity conditions. It is therefore necessary to dry the moist tobacco under high humidity conditions while also preventing damaging contact to the tobacco material.

U.S. Pat. No. 4,167,191 teaches a process for high humidity drying of tobacco material in order to reduce the moisture content of expanded tobacco while minimizing yield losses and reducing particle lamination while maintaining filling power. The air temperature used to dry the tobacco is within a range of around 250° F. to about 650° F. in the presence of an absolute humidity at a level above that which will provide a wet-bulb temperature reading of at least about 150° F.

U.S. Pat. No. 4,315,515 teaches a tobacco drying apparatus having a plurality of expansion chambers which effect a drying of the tobacco within a high humidity environment. The drying chambers are utilized to reduce the velocity of the air flow through the apparatus as well as a dryer means to effect drying of the air entrained tobacco to the desired moisture level. However, the apparatus requires long extensions of air ducting as well as several air redirection areas or elbows which cause the tobacco to come into contact with the walls of the ducts in the air chambers causing tobacco breakup, sanitary, cleaning and other problems within the apparatus.

SUMMARY OF THE INVENTION

The present invention is for a high humidity tobacco drying apparatus and more particularly a high humidity cut tobacco drying apparatus which requires minimal residence time of the cut tobacco in the drying and expansion chamber.

More particularly, the present invention comprises a heated air intake duct which provides air at a predetermined temperature and humidity level. The air intake duct enters into a first arcuate elbow wherein cut tobacco is mixed in the high velocity heated air by an upwardly extending trapezoidal inlet. The first arcuate elbow redirects the air flow from a horizontal airflow to a vertical airflow. The outer wall of the interior first elbow has a water cooled door which opens outwardly for access to the interior of said drying apparatus. The first elbow redirects the tobacco entrained airflow vertically into a long vertically extending drying and expansion chamber. The vertically extending drying chamber ends at a second elbow which redirects the airflow into a tangential separator. The second elbow also has a water cooled door on the interior outer wall thereby preventing buildup of casings and other materials on the interior surface of the elbow. The tangential separator provides a means for removing the cut tobacco from the high velocity air stream by reducing the velocity of the airflow and allowing the tobacco entrained therein to fall out of the airstream and into a rotary airlock. The heated air stream exits the separator from both side walls of the tangential separator, each of said exhausts entering a high efficiency cyclone for further separation and removal of any tobacco material remaining in the airstream.

Finally, the present invention comprises a high humidity drying apparatus for drying cut tobacco, comprising: a longitudinally extending heated air intake duct; a first arcuate elbow in flow communication with said intake duct and having a downward preselected angle of curvature, said first elbow having a hinged water-cooled door on an outer wall; an upwardly extending tobacco inlet of trapezoidal cross-section in flow communication with said first elbow, said upwardly extending tobacco inlet formed on said first elbow at a point where the vertical expansion of the first arcuate elbow begins; a vertically extending drying chamber in flow communication with said first elbow; a second arcuate elbow in flow communication with said vertically extending drying chamber said second elbow having a hinged water cooled door on an outer wall; a tangential separator in flow communication with said second elbow, said separator having a tobacco outlet airlock, said separator also having a first and a second centrally aligned perpendicular air exhaust on opposed sides, said first air exhaust being in flow communication with a first high efficiency cyclone and said second air exhaust in flow communication with a second high efficiency cyclone.

BRIEF DESCRIPTION OF THE DRAWINGS

A better understanding of the invention will be had upon reference to the following description in conjunction with the accompanying drawings in which like numerals refer to like parts and wherein.

DETAILED DESCRIPTION OF THE PREFERRED EMBODIMENT

Figures 1, 2, 8:
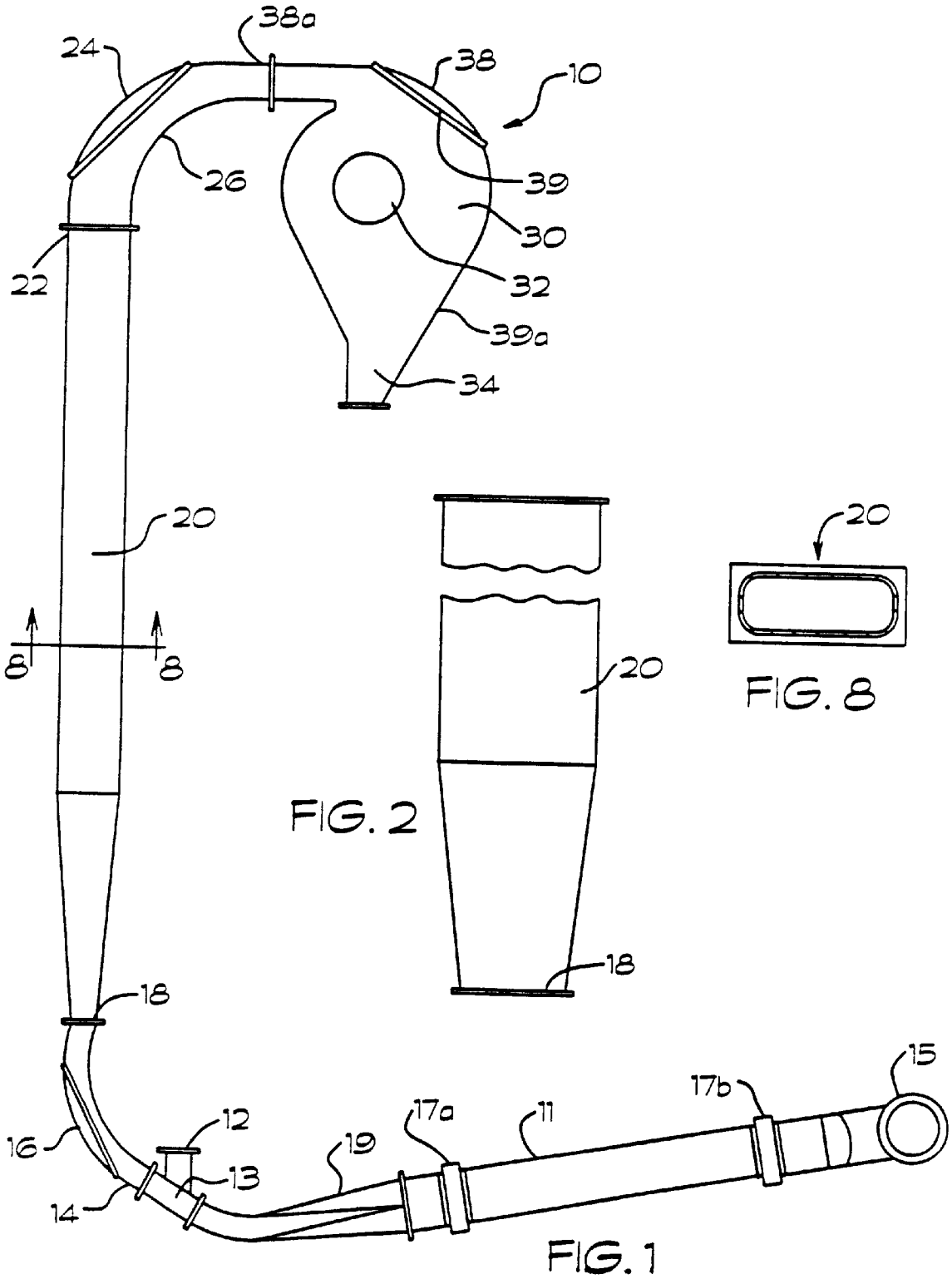
FIG. 1 is a side view of a high humidity drying apparatus of the present invention.
FIG. 2 is a front view of a vertically extending drying and expansion chamber of FIG. 1.

As shown in FIG. 1, a high humidity drying apparatus 10 of the present invention is comprised of multiple duct sections 11, 14, 20, 26 and 30. Air for use in the apparatus 10 is heated in a furnace (not shown). The circulated air, after heating, is raised to an appropriate moisture level to create high humidity drying conditions. Moisture is added by injecting steam into the air stream in order to raise the moisture level of the circulated heated air to the appropriate level. This also serves to raise the temperature of the circulated air within the drying apparatus itself. The moisture level of the airstream is closely monitored in order to provide a wet-bulb temperature of, for example, at least about 210° F. as that term is defined in U.S. Pat. No. 4,167,191.

A heated air inlet 15 receives the air from the furnace at a relatively high velocity such as, for example, from 5,000 to about 8,000 feet per minute. A heated air intake duct 11 is disposed in flow communication with and downstream from inlet 15 with expansion joints 17*a* and 17*b* being provided to allow for the heated air intake duct 11 to expand and contract as the air is passed therethrough. The heated air intake duct 11 has a height of about 18 inches and a width or depth of about 66 inches. The average air temperature at the heated air intake duct 11 is generally maintained at around 360° F. The air in the heated air intake duct 11 has a velocity of, for example, about 6300 ft./min. as it is accelerated into a narrow entry throat 19 of first arcuate elbow 14.

The entry throat 19 of first arcuate elbow 14 is tapered inwardly thereby providing first arcuate elbow 14 with an inner diameter less than heated air intake duct 11. Heated air intake duct 11, as shown in FIG. 1, has a downward angle of approximately about 12 to 13 degrees from horizontal before first elbow 14 turns upwards to redirect the airflow accordingly. After first elbow 14 turns upwards, a trapezoidal inlet airlock 12 is provided as the means to add cut tobacco into the airstream. Inlet airlock 12 is generally of a trapezoidal cross-section and is positioned above elbow 14 allowing the tobacco to fall vertically into the airstream flowing through elbow 14 below airlock 12. Inlet airlock 12 has located therein a rotary airlock 12*a*, shown in FIG. 4, for incremental addition of the cut tobacco into the airstream thereby preventing a decrease in the pressure and speed of the airflow therebelow.

The cut tobacco which enters inlet airlock 12 usually has casings, flavorings and other additives blended therewith and exhibits a total moisture content of generally about 21% to 23% by weight. In a preferred operation, cut tobacco is passed through the airlock 12 at a rate of, for example, between about 14,000 lb/hr and about 49,000 lb/hr.

Figure 4:
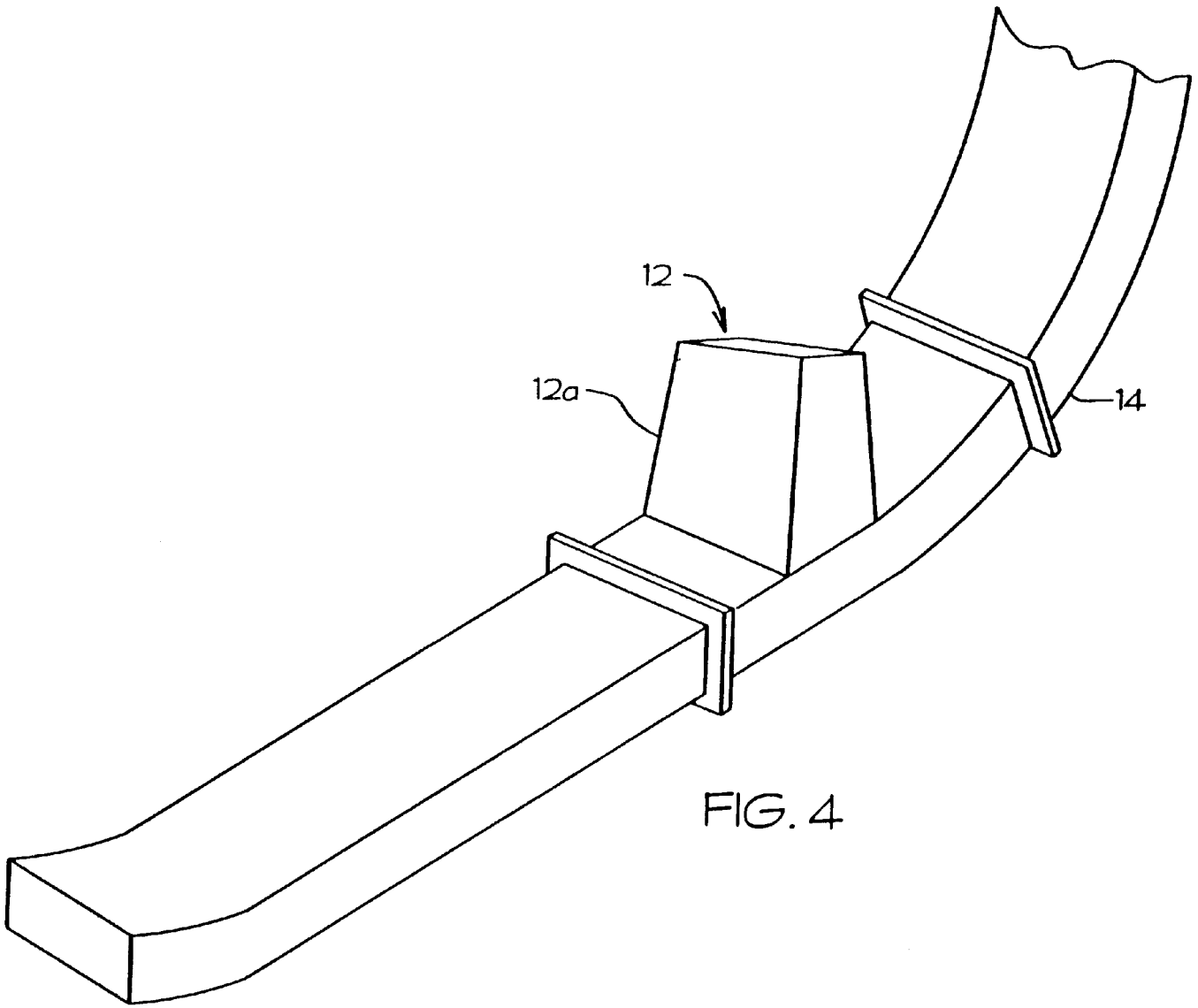
FIG. 4 is a perspective view of the tobacco inlet area.

As shown in FIG. 1, after narrowing along narrow neck portion 19, elbow 14 is provided with an increasing diameter section starting at a position identified by vertical expansion line 13 at the juncture with the inlet airlock 12. This vertical expansion line 13 prevents a negative pressure point forming within the inlet airlock 12 and expands along the interior angle of curvature of the elbow 14. The increasing height of the interior of the elbow 14 at the vertical expansion line 13 of the airlock 12 causes a zero pressure point to form just above the expansion line 13 of first elbow 14 and within the airlock 12 itself. This vertical expansion increases the height of the arcuate elbow 14 from about 27 inches just before the tobacco inlet area in expansion area 13 to about 32 inches. The zero pressure point within the airlock 12 prevents backflow of the cut tobacco into the airlock and keeps the cut tobacco flowing into the airstream with minimal buildup of the tobacco in the airlock. A better diagram of the trapezoidal design of the inlet airlock is shown in FIG. 4 within which is located a rotary airlock 12*a* which incrementally allows tobacco into the airstream flowing therebelow under high velocity. Cut tobacco enters the airlock from a vibrating conveyor system which provides the tobacco after fine cutting by a separate cutting apparatus. The cut tobacco has a moisture content of around 21% to 23% as stated previously. By implementing the widening of the airlock 12 at expansion line 13, the cut tobacco is prevented from backflowing into the airlock which can occur when negative pressure is formed within the airlock chamber. The trapezoidal cross-sectional airlock allows the cut tobacco to be fed into the main airstream at a relatively high rate of, for example, approximately 30,000 pounds/hour on average or greater, without clogging the airlock portion of the drying apparatus or oversaturating the airstream.

The overall design of the present invention creates a double null point pressure configuration which is caused directly by the design of the venturi at the tobacco inlet 12. A first pressure null point is formed just within inlet area 12 to prevent backflow of the tobacco in the tobacco inlet area 12. A second null point is created within tangential separator 30 just below the air exhausts 32 and 36 which exit the separator centrally therein. As stated, this double null point configuration aids in transporting the cut tobacco through the drying apparatus and ensuring a smooth flow of material throughout the drying apparatus 10.

Figure 5:
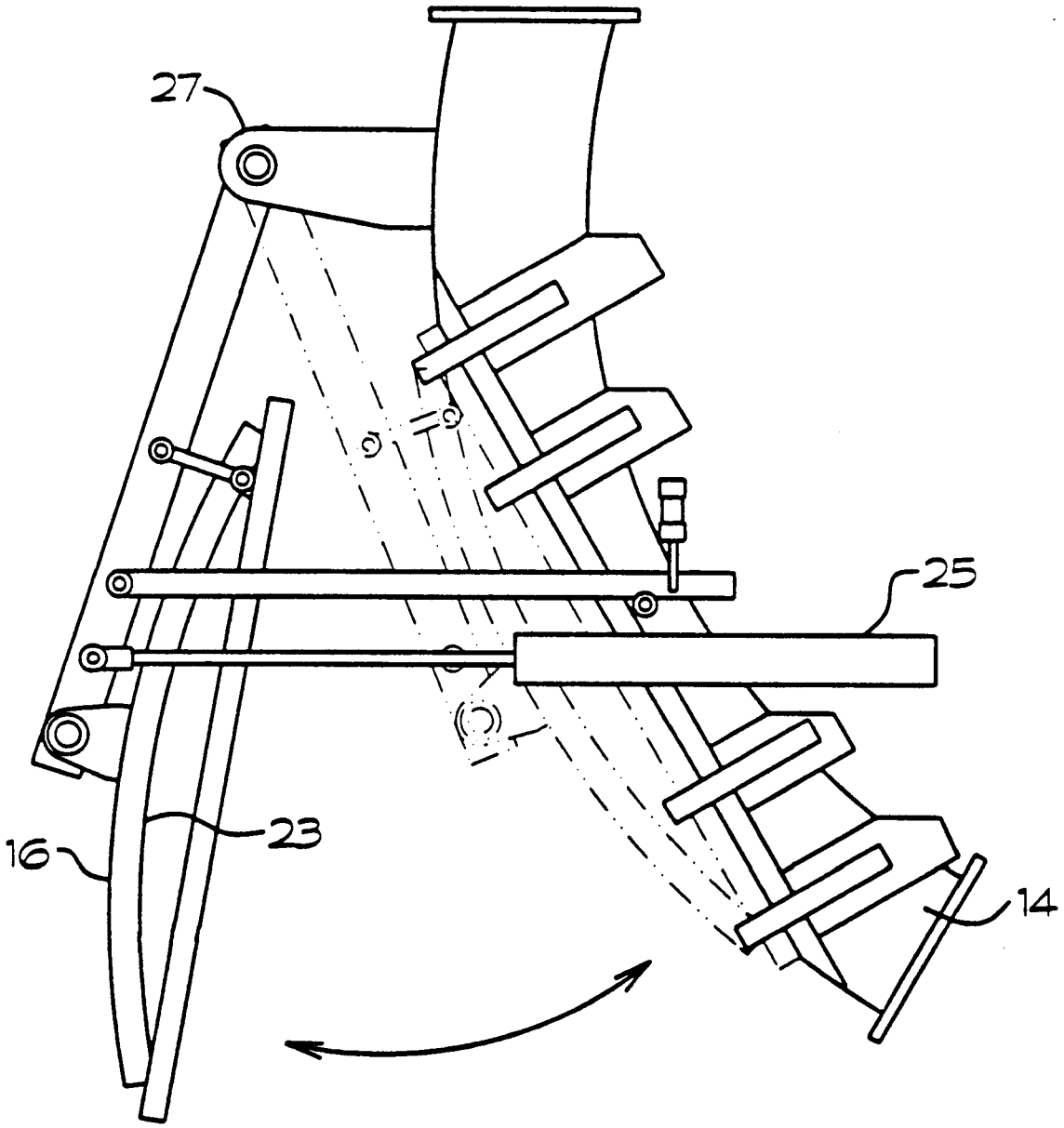
FIG. 5 is a side view of the water cooled door on the first arcuate elbow.

As shown in FIG. 1, first elbow 14 is provided with a water cooled exterior door 16. Water cooled door 16, shown in FIG. 5, provides access to the interior of the first elbow 14 of drying apparatus 10. Door 16 is provided with a curved interior outer wall 23 which comes into contact with the cut tobacco and the moist flavorings and casings added thereon. Chilled water is circulated through the door 16 within interior channels which repeatedly cross the length of the door 16 in back and forth fashion in order to keep a layer of condensated moisture on interior outer wall 23 which in turn prevents buildup of the casings and flavorings. These channels are formed in a back and forth direction in order to cover as much surface area of the door 16 as possible. The buildup of material on the outer wall 23 can present hygiene problems as well as reduce the smooth flow of tobacco material which comes into contact with the interior outer wall 23. By passing chilled water through interior pipes of the door 16, a condensation layer is created on interior outer wall 23 which allows the cut tobacco to come into contact with the layer of moisture on the wall preventing deposits of any of the casings or flavorings on the interior of the drying apparatus.

Water cooled door 16 is also attached to air cylinder 25 which allows the door to be opened and closed. Door 16 is hinged at point 27 to facilitate the opening and closing action. While interior outer wall 23 of door 16 is curved, a flat contact surface 25 is utilized in order to provide a flat smooth sealing surface. This flat contact surface 25 allows proper sealing of the door 16 onto elbow 14 while still providing a hinged access point into the apparatus. By providing water cooled door 16, buildup on the interior outer wall 23 is kept to a minimal level and access is provided into the interior of the drying apparatus for inspection and cleaning when required.

Returning to FIG. 1, downstream from first arcuate elbow 14 is vertically extending drying and expansion chamber 20. And, as best shown in FIG. 2 at the downstream terminating end of first elbow as identified by the numeral 18 marks the beginning of the expansion of the interior of the drying chamber. Vertical drying chamber 20 extends upwards generally about, for example, 42 to 60 feet to provide adequate distance and drying time for the cut tobacco. In order to dry the cut tobacco to the appropriate moisture level, tobacco entrained within the airstream will remain in the drying chamber 20 until it reaches a predetermined moisture content, usually for example, about 13% to 15% by weight. If the moisture content of the tobacco is too high, the tobacco will be too heavy to rise to the second elbow 26. In addition, to ensure the proper flow of tobacco within the apparatus and especially in the vertical drying and expansion chamber 20, the walls of the vertical drying chamber 20 are rounded at the corners of the chamber, as shown in FIG. 8, to prevent contact of the moist tobacco with the interior ducts of the drying apparatus thereby causing airflow or hygiene problems. This curved or circular design promotes a smooth airflow through the drying apparatus 10 by removing the 90° corners where circulating air may stagnate and lessen tobacco flow capability. Typically, within the corners of the ducting, airflow tends to stagnate or become less active thereby preventing the proper flow of the tobacco entrained within the air.

Figure 6:
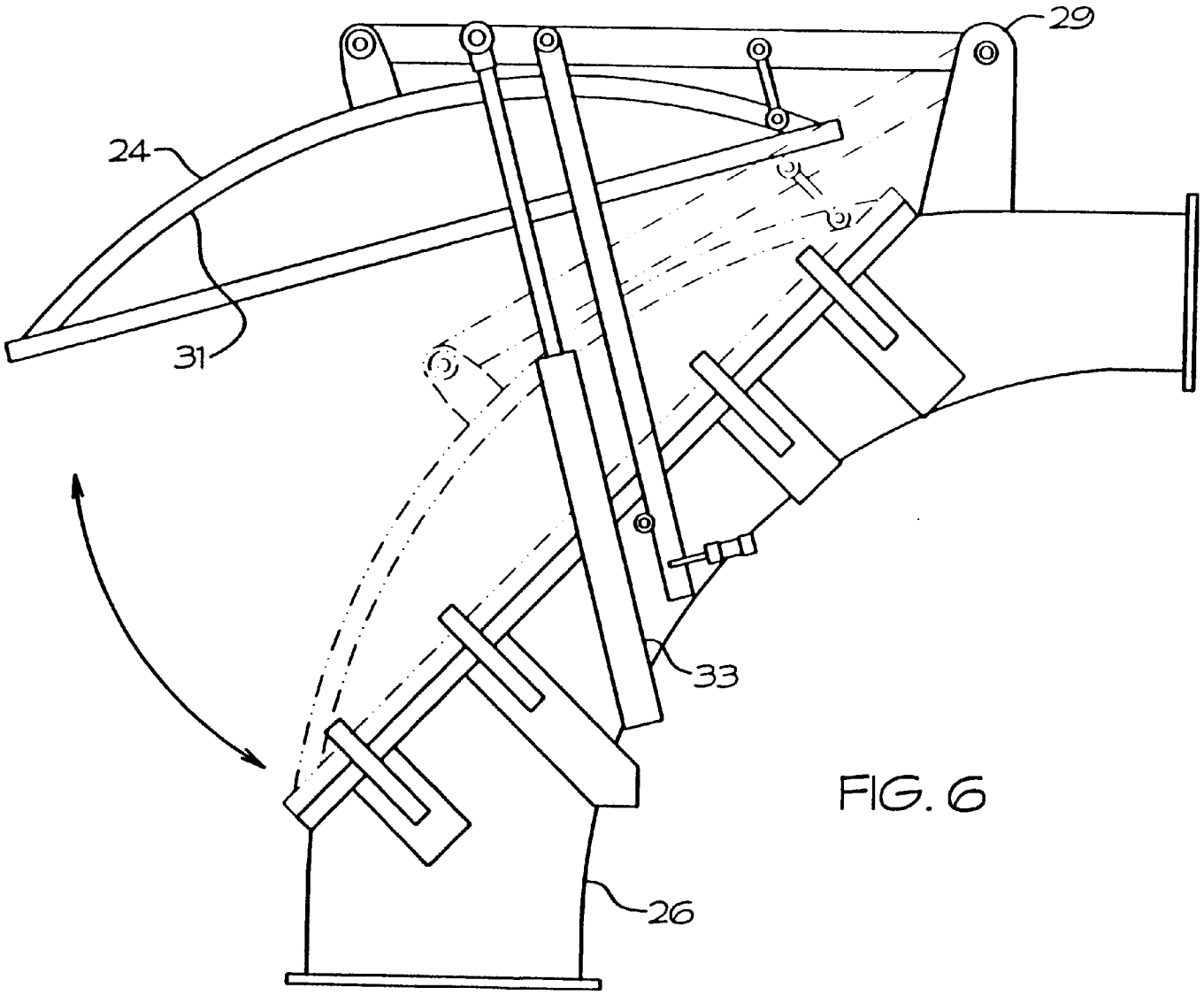
FIG. 6 is a side view of the water cooled door on the second arcuate elbow.

Downstream of the vertical drying chamber 20 and in flow communication therewith is second arcuate elbow 26 which, as with first elbow 14, is fitted with an outwardly extending water cooled door 24. Second elbow 26 is disposed to redirect the air entrained tobacco from the vertical direction to horizontal. Second elbow door 24 being water cooled as is the first elbow door 16, prevents buildup of material on outer interior wall surface 31 shown in FIG. 6. The water which is passed through the interior of the door 24, as with first elbow door 16, is kept at a controlled temperature of, for example, about 190° F. This temperature is optimal in that it is approximately 20° F. below the appropriate wet-bulb temperature of the tobacco. A fine condensation layer of water is thus formed on the interior elbow wall 31 allowing the tobacco entrained within the airflow to contact wall 31 without leaving residue on the inner ducts of the drying apparatus. Door 24 is also hinged at a point identified by numeral 29 and has an air cylinder 33 attached thereto which provides means to raise and lower the door 24.

Figure 3:
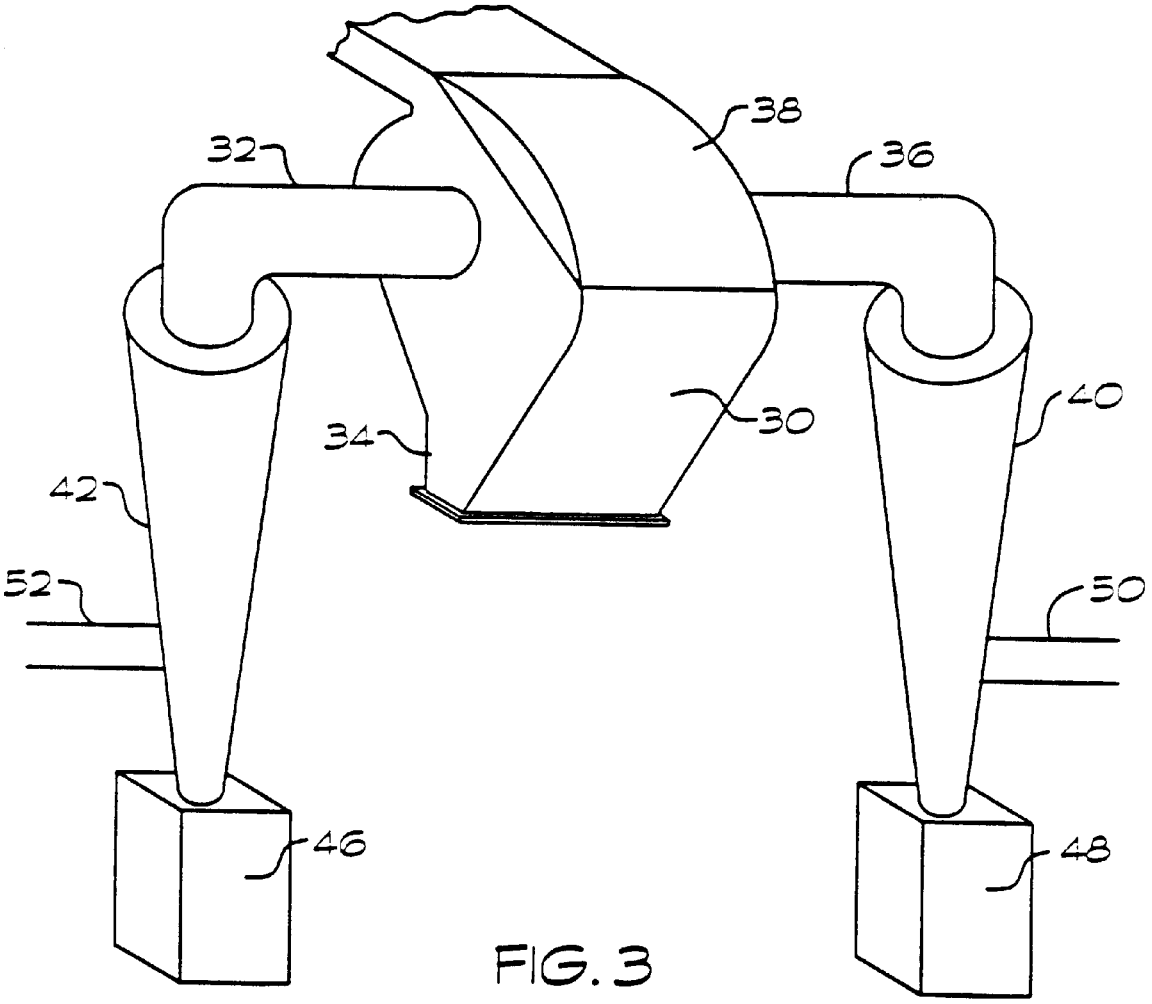
FIG. 3 is a perspective view of the tangential separator, the two air exhausts and the first and second high efficiency cyclone of FIG. 1.
Figure 7:
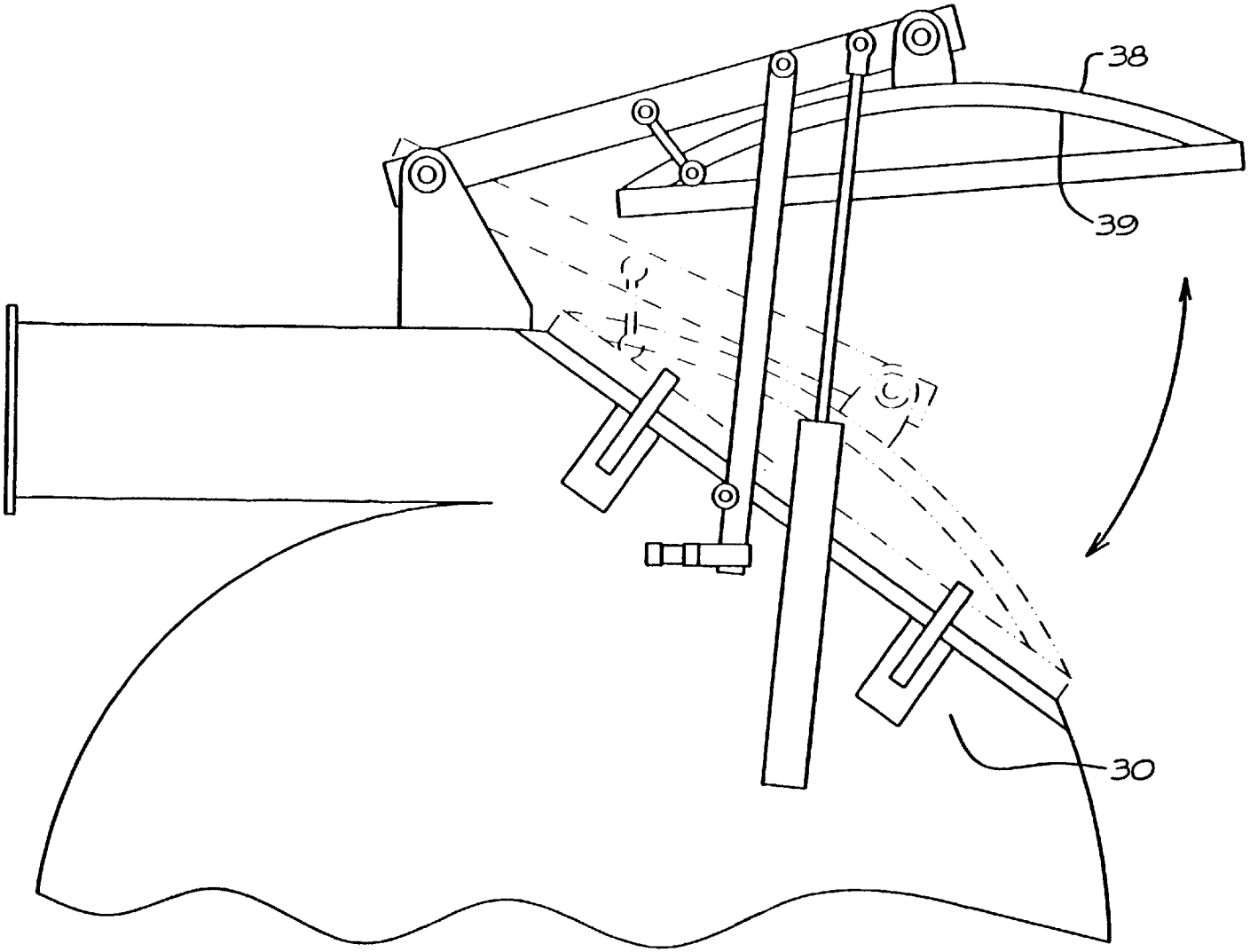
FIG. 7 is a side view of the tangential separator and the water cooled door of its upper edge; and, FIG. 8 is a cut away bottom view of the vertically extending drying and expansion chamber of FIG. 1.

Downstream from and in flow communication with second arcuate elbow 26 is tangential separator 30 which in turn is in flow communication with dual high efficiency cyclones 40 and 42. As stated previously, the airflow velocity within the drying apparatus is maintained at, for example, about 6300 ft/min. In order to remove the tobacco from the high velocity airstream, the tangential separator 30 forces the tobacco against an interior surface or wall 39 of hinged water cooled door 38 shown in FIG. 7. This reduces the velocity of the cut tobacco so that it can be removed from the airflow. And, chilled water flows through the interior of hinged door 38 in order to prevent buildup of material on interior surface wall 39. The velocity of the airflow within the drying apparatus 10 is reduced as it circulates around the interior of tangential separator 30 thereby allowing the cut tobacco to fall into rotary airlock 34. As shown in FIG. 3, the heated air is exhausted through dual air exhaust exit ducts 32 and 36 while the majority of the dried tobacco drops out of the airstream and into the rotary airlock 34 for further processing. Each air exhaust 32 and 36 are centrally aligned an on opposite sides of the tangential separator and remove air from the separator 30 through a multi-vaned rotary exhaust located centrally within separator 30. Each of the air exhausts 32 and 36 lead to cyclones for the further removal of the cut tobacco from the circulated air stream. Exhaust from the separator must be properly balanced to each of the exhausts exit lines 32 and 36 so that the proper airflow is exhibited within the drier to prevent buildup of material in the second elbow 26. The ratio between the drying chamber 22 and the tansition leading to the separator 38*a*, as shown in FIG. 1, is approximately 0.4.

A second zero pressure point is formed within the drying apparatus in the tangential separator 30 in order to assist in product removal from the interior ducts of tansition area 38*a* and second elbow area 24. The moisture content of the cut tobacco at the airlock 34 is reduced to about 15% to 17% moisture content and is elevated to a temperature of about 210° F.

The air exhausted through ducts 32 and 36 will still have small amounts of tobacco within the airstream. To further filter the air and remove this material, high efficiency cyclones 40 and 42 are provided in order to deposit further tobacco dust and material into removal bins 46 and 48 while allowing the heated air to exhaust through ducts 50 and 52 and recirculate back into the drying apparatus. The drying apparatus 10 can then utilize this heated air back into the heated air intake duct 11 for processing of additional cut tobacco. The total dwell time of the cut tobacco within the drying apparatus 10 is only about 3 seconds and the moisture content is reduced from about 21% to 23% to about 15% to 17% in that short amount of time. Additionally, the drying apparatus 10 reduces breakage of the cut tobacco thereby increasing the filling capacity of the material while also reducing the amount of contact the cut tobacco has with the interior walls of the apparatus. This not only increases the filling capacity of the material but also reduces the maintenance costs of the drying apparatus as the interior does not require extensive and continuous cleaning. To prevent further deposits of tobacco casing and flavoring material on the interior of the drying apparatus 10 and specifically within the tangential separator 30, back wall 39*a* of the tangential separator is also water cooled to generate a thin layer of condensate which buffers the contact of the cut tobacco on the interior walls.

EXAMPLE 1

A test run of the new drying apparatus was conducted under the specifications outlined above. The results of the dried cut tobacco were compared with cut tobacco dried in a prior art device such as that described in U.S. Pat. No. 4,315,515. The results are shown below. As can be seen, the moisture content of the cut tobacco remained about the same while the total drying time/resident time within the drying apparatus was reduced from about 8 seconds to about 3 seconds. The tobacco dried in the drying apparatus of the present invention exhibited a much greater fill value. Moisture from the table is read as the percent wet weight basis. Fill value is determined in cubic centimeters per gram. Propylene Glycol is measured in percent. Particle size measurements are determined based upon +9 mesh sieving process where the value displayed is the percentage of particles which have a particle size of +9 or larger. This value is desired to be as large as possible because it is a good indication of the degradation of the tobacco during the drying process. Finally, the −14 particle size measurement determines the percentage of particles under 14 mesh and is desired to be as small as possible.

TABLE 1

| Property | Process | Inlet Dryer Average Moisture | Exit Dryer Average Moisture | Percent Change |
|---|---|---|---|---|
| Moisture | Existing | 21.8 | 14.4 | N/A |
| | New | 22.1 | 13.5 | |
| Fill-Value | Existing | 4.73 | 5.03 | +6 |
| | New | 4.84 | 5.41 | +12 |
| Propylene Glycol | Existing | 0.58 | 0.49 | −16 |
| | New | 0.59 | 0.57 | −3 |
| +9 Particle Size | Existing | 77.6 | 73.7 | −5 |
| | New | 72.9 | 70.6 | −3 |
| −14 Particle Size | Existing | 6.5 | 9.1 | +40 |
| | New | 8.4 | 10.8 | +28 |

The foregoing detailed description is given primarily for clearness of understanding and no unnecessary limitations are to be understood therefrom for modifications will become obvious to those skilled in the art upon reading this disclosure and may be made without departing from the spirit of the invention or the scope of the appended claims.

What is claimed is:

1. A high humidity drying apparatus for drying cut tobacco, comprising:

a longitudinally extending heated air intake duct;

a first elbow in flow communication with said intake duct and having an inlet airlock;

a vertically extending drying chamber in flow communication with said first elbow, said drying chamber having an expanding cross sectional area;

a second elbow in flow communication with said drying chamber; and, a tangential separator in flow communication with said second elbow, said separator having a tobacco outlet airlock.

2. The drying apparatus of claim 1 wherein said tangential separator further comprises:

an air exhaust; and, a high efficiency cyclone in flow communication with said air exhaust of said tangential separator.

3. The apparatus of claim 2 wherein said air exhaust of said tangential separator is further comprised a first and a second centrally aligned perpendicular air exhaust on opposed sides, said first air exhaust being in flow communication with a first high efficiency cyclone and said second air exhaust in flow communication with a second high efficiency cyclone.

4. The drying apparatus of claim 1 wherein said first elbow has a hinged water-cooled door on an outer wall.

5. The apparatus of claim 4 wherein said water cooled door on said first elbow has a plurality of water channels formed therein.

6. The drying apparatus of claim 1 wherein said second elbow has a hinged water cooled door on an outer wall.

7. The apparatus of claim 6 wherein said water cooled door on said second elbow has a plurality of water channels formed therein.

8. The apparatus of claim 1 wherein said tobacco has a moisture content at said outlet airlock in said tangential separator of from about 13% to 15% by weight.

9. The apparatus of claim 1 wherein said air temperature in said apparatus is maintained at from about 320 to about 420 degrees F.

10. The apparatus of claim 1 wherein said tobacco has a moisture content at said inlet airlock of from about 21% to 23% by weight.

11. The apparatus of claim 1 wherein said airflow within said apparatus has an average velocity of about 6300 ft/min at said tobacco inlet.

12. The apparatus of claim 1 wherein said air intake duct has a downward preselected angle of curvature.

13. The apparatus of claim 1 wherein said vertically extending drying chamber is about 60 feet in length.

14. The apparatus of claim 1 wherein said tangential separator is further provided with a hinged water cooled door.

15. The apparatus of claim 1 wherein the interior duct of said drying apparatus is comprised of rounded corners.

16. The apparatus of claim 1 wherein said air intake duct has a cross sectional width of about 66 inches and a height of about 18 inches.

17. The apparatus of claim 1 wherein said first arcuate elbow has a vertical expansion of about 32 inches to about 27 inches at said tobacco inlet area.

18. The apparatus of claim 1 wherein said apparatus exhibits a zero pressure point within said inlet airlock and within said tangential separator.

* * * * *